US008136686B2

(12) United States Patent
Schlatter

(10) Patent No.: US 8,136,686 B2
(45) Date of Patent: Mar. 20, 2012

(54) DISPENSING CONTAINER

(76) Inventor: Gary Schlatter, Englewood, CO (US)

( * ) Notice: Subject to any disclaimer, the term of this patent is extended or adjusted under 35 U.S.C. 154(b) by 2527 days.

(21) Appl. No.: 10/623,588

(22) Filed: Jul. 22, 2003

(65) Prior Publication Data

US 2005/0017004 A1 Jan. 27, 2005

(51) Int. Cl.
*B65D 25/28* (2006.01)
*A45F 5/02* (2006.01)

(52) U.S. Cl. ..... 220/212.5; 220/751; 220/756; D8/395; D9/443; 24/265 H; 224/268; 224/269; 224/148.7

(58) Field of Classification Search ..... 220/212.5, 220/751, 756; D8/395; D9/443; 24/265 H; 224/148.7, 268, 269
See application file for complete search history.

(56) References Cited

U.S. PATENT DOCUMENTS

| | | | | | |
|---|---|---|---|---|---|
| 250,112 | A | * | 11/1881 | Truitt | 24/165 |
| 384,512 | A | * | 6/1888 | Dillon | 24/165 |
| 395,663 | A | * | 1/1889 | McCord | 24/165 |
| 641,316 | A | * | 1/1900 | Meyer | 24/598.5 |
| D102,151 | S | | 12/1936 | Stein et al. | |
| D190,204 | S | * | 4/1961 | Muller | D9/443 |
| 3,240,384 | A | * | 3/1966 | Lermer | 220/780 |
| 3,306,266 | A | | 2/1967 | McCunney | |
| 3,483,285 | A | * | 12/1969 | Foley | 264/146 |
| 3,495,797 | A | * | 2/1970 | Ganz | 248/339 |
| 3,748,703 | A | * | 7/1973 | Maillocheau | 24/265 H |
| D273,940 | S | * | 5/1984 | Soos et al. | D9/529 |
| D292,554 | S | * | 11/1987 | Yagi | D8/396 |
| D293,205 | S | * | 12/1987 | Nakano | D8/395 |
| D302,938 | S | * | 8/1989 | Fujioka | D8/356 |
| 4,891,961 | A | * | 1/1990 | Tsamas | 70/456 R |
| D311,139 | S | * | 10/1990 | Butler | D9/443 |
| 5,067,836 | A | | 11/1991 | Khan | |
| D341,227 | S | | 11/1993 | Lang et al. | |
| D347,297 | S | | 5/1994 | Vesco | |
| D374,611 | S | | 10/1996 | Bonoan et al. | |
| 5,682,981 | A | | 11/1997 | Sudborough | |
| 5,769,254 | A | * | 6/1998 | King et al. | 215/330 |
| D409,830 | S | | 5/1999 | Stafford | |
| 5,996,191 | A | * | 12/1999 | Christler | 24/598.2 |
| D422,503 | S | * | 4/2000 | Lehn | D9/503 |
| D433,562 | S | | 11/2000 | Redlinger | |

(Continued)

*Primary Examiner* — Anthony Stashick
*Assistant Examiner* — James N Smalley
(74) *Attorney, Agent, or Firm* — Welsh Flaxman & Gitler LLC

(57) ABSTRACT

A dispensing container includes a selectively removable cap to which a variety of articles may be securely and selectively attached. The dispensing container includes a dispensing body in which material for dispensing is stored. The dispensing body includes a closed end, at least one side wall and an open end through which the material is dispensed. The dispensing container also includes a cap shaped and dimensioned for selectively covering the open end of the dispensing body. The cap includes a first end shaped and dimensioned for frictionally engaging the open end of the dispensing body for secure and selective attachment thereto and a closed second end including a clasp extending therefrom. The clasp includes a first arm and a second arm. The first arm includes a first arcuate member and a first upwardly extending connecting member linking the first arcuate member to the cap, and the second arm includes a second arcuate member and a second upwardly extending connecting member linking the second arcuate member to the cap. The first arm and the second arm are oriented upon the cap so as to overlap in a mating configuration with the first arm lying over the second arm, the first arcuate member and the second arcuate member overlapping through a substantial portion of their respective arcs.

20 Claims, 1 Drawing Sheet

U.S. PATENT DOCUMENTS

D434,896 S 12/2000 Haugh et al.
D446,355 S 8/2001 Weinstock
D448,524 S 9/2001 Colla
D515,418 S * 2/2006 Sandler ..... D9/434
2004/0217139 A1* 11/2004 Roth et al. ..... 224/148.7
2004/0250386 A1* 12/2004 Goldberg ..... 24/601.5

* cited by examiner

DISPENSING CONTAINER

BACKGROUND OF THE INVENTION

1. Field of the Invention

The invention relates to a dispensing container. More particularly, the invention relates to a dispensing container including a cap having a clasp adapted for attachment to a variety of articles.

2. Description of the Prior Art

The use of lanyards as a means for carrying items has recently seen substantial growth. In addition to identification badges, people use their lanyards to carry a wide variety of items, including dispensing containers. Unfortunately, however, most dispensing containers are not well adapted for secure and easy attachment to a lanyard. For example, most currently available dispensing containers are either difficult to utilize in conjunction with a lanyard or are not capable of secure attachment to the lanyard. While some clips have been developed for the attachment of dispensing containers to lanyards (albeit developed with structures limiting their effectiveness), these clips are not readily adapted for use in attaching dispensing containers to other structures, such as, zippers, belts, key chains, backpacks, golf bags etc.

As such, a need exists for a dispensing container offering a convenient and reliable mechanism for attachment to various articles, for example, lanyards. The present invention provides such a dispensing container.

SUMMARY OF THE INVENTION

It is, therefore, an object of the present invention to provide a dispensing container including a selectively removable cap to which a variety of articles may be securely and selectively attached. The dispensing container includes a dispensing body in which material for dispensing is stored. The dispensing body includes a closed end, at least one side wall and an open end through which the material is dispensed. The dispensing container also includes a cap shaped and dimensioned for selectively covering the open end of the dispensing body. The cap includes a first end shaped and dimensioned for frictionally engaging the open end of the dispensing body for secure and selective attachment thereto and a closed second end including a clasp extending therefrom. The clasp includes a first arm and a second arm. The first arm includes a first arcuate member and a first upwardly extending connecting member linking the first arcuate member to the cap, and the second arm includes a second arcuate member and a second upwardly extending connecting member linking the second arcuate member to the cap. The first arm and the second arm are oriented upon the cap so as to overlap in a mating configuration with the first arm lying over the second arm, the first arcuate member and the second arcuate member overlapping through a substantial portion of their respective arcs.

It is also an object of the present invention to provide a dispensing container wherein the first arcuate member has a slightly smaller radius of curvature than the second arcuate member.

It is another object of the present invention to provide a dispensing container wherein the first arcuate member extends along an arc which is larger than the arc of the second arcuate member.

It is also another object of the present invention to provide a dispensing container wherein the first arm and the second arm are positioned approximately 2 mm or less from one another.

It is also an object of the present invention to provide a dispensing container wherein the clasp includes a first arm and a second arm, and the first arm includes a first arcuate member extending along an arc of at least 120 degrees and the second arm includes a second arcuate member extending along an arc of at least 120 degrees. The first arm and the second arm are oriented upon the cap so as to overlap in a mating configuration with the first arm lying over the second arm, the first arcuate member and the second arcuate member overlapping through at least a 60 degree arc.

Other objects and advantages of the present invention will become apparent from the following detailed description when viewed in conjunction with the accompanying drawings, which set forth certain embodiments of the invention.

DESCRIPTION OF THE PREFERRED EMBODIMENT

The detailed embodiment of the present invention is disclosed herein. It should be understood, however, that the disclosed embodiment is merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
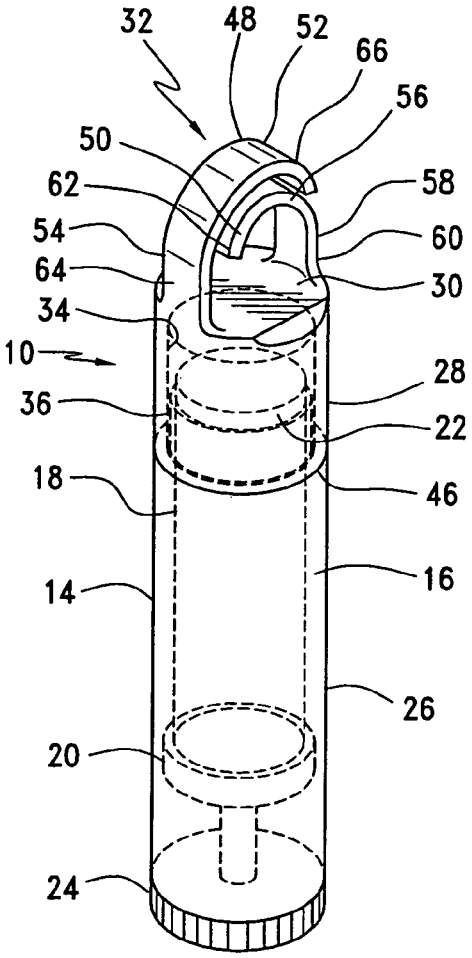
FIG. 1 is a perspective view of the present dispensing container with the internal components shown in phantom
Figure 2:
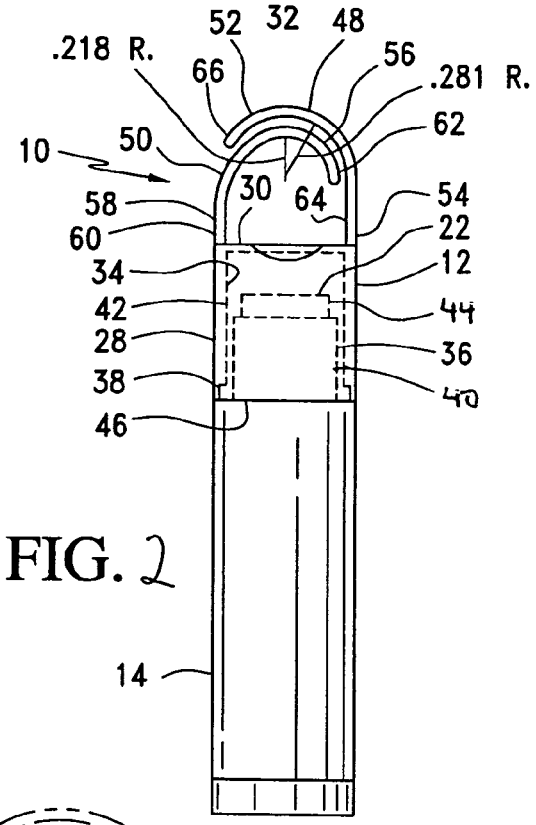
FIG. 2 is a side view of the dispensing container shown with reference to FIG. 1.
Figure 3:
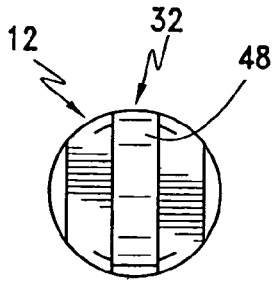
FIG. 3 is a top view of the present dispensing container.
Figure 4:
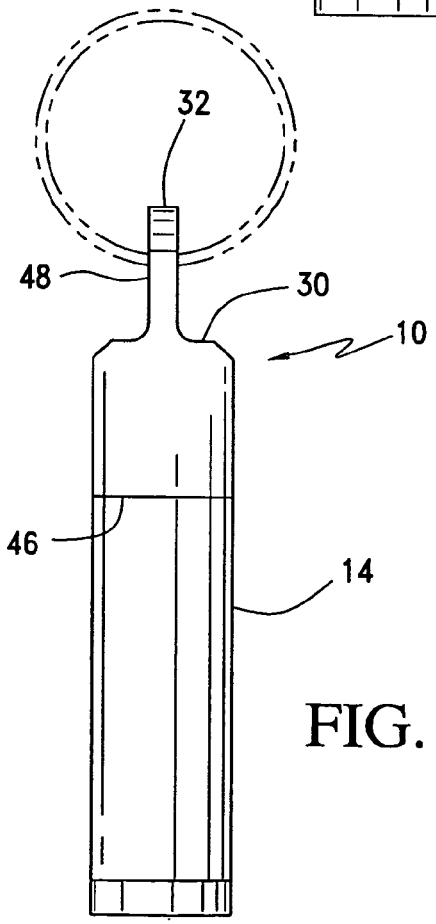
FIG. 4 is a side plan view of the present dispensing container.

With reference to FIGS. 1 to 4, a dispensing container 10 is disclosed. The dispensing container 10 is specifically adapted for attachment to a lanyard or for attachment of small items thereto. With this in mind, the dispensing container 10 generally includes a selectively removable cap 12 to which a variety of articles may be securely and selectively attached, including, for example, a lanyard, key ring, ornament, etc.

More particularly, the dispensing container 10 includes a dispensing body 14 in which material for dispensing is stored. In accordance with a preferred embodiment of the present invention, the dispensing body 14 is similar to those commonly utilized in the dispensing of lip balms. This preferred embodiment includes a central cavity 16 in which lip balm 18 is stored and a screw type dispensing mechanism 20 for moving the lip balm 18 toward the open end 22 of the dispensing body 14 in a controlled manner. While a lip balm dispenser is disclosed in accordance with a preferred embodiment of the present invention, the dispensing body may take a variety of forms without departing from the spirit of the present invention. In general, the dispensing body 14 need only include a closed end 24, at least one side wall 26 and an open end 22 through which the material is dispensed.

As mentioned above, the dispensing container 10 includes a cap 12 to which a variety of objects may be selectively secured. The cap 12 is shaped and dimensioned for selectively covering the open end 22 of the dispensing body 14. The cap 12 includes a first end 28 shaped and dimensioned for frictionally engaging the open end 22 of the dispensing body 14 for secure and selective attachment thereto and a closed second end 30 including a clasp 32 extending therefrom.

Frictional engagement of the cap 12 to the open end 22 of the dispensing body 14 is achieved by providing both the internal wall 34 of the cap 12 and the external wall 36 of the dispensing body 14 adjacent the open end 22 thereof with two-stepped profiles. The two-stepped profiles utilized in both the cap 12 and the dispensing body 14 allow a user to align the cap 12 and the dispensing body 14 through the use of the large/small diameter profiles of the cap 12 and the dispensing body 14, and subsequently matingly engage the cap 12 and the dispensing body 14 when the cap 12 is pushed over the dispensing body 14 such that the small/large diameter profiles of the cap 12 and dispensing body 14 are engaged.

Specifically, the internal wall 34 of the cap 12 adjacent the first end 28 of the cap 12 is provided with a large diameter profile 38 directly adjacent the first end 28 thereof. Slightly above the large diameter profile 38, the cap 12 is provided with a small diameter profile 42. The external wall 36 of the dispensing body 14 adjacent the open end 22 thereof is provided with a large diameter profile 40. Similarly, the dispensing body 14 is provided with a small diameter profile 44 slightly above the large diameter profile 40 thereof.

The large diameter profile 38 of the cap 12 is slightly larger than the large diameter profile 40 of the dispensing body 14 such that the cap 12 and dispensing body 14 may be aligned prior to placement of the cap 12 upon the dispensing body 14. The small diameter profile 42 of the cap 12 and the large diameter profile 40 of the dispensing body 14 are substantially the same size, with the small diameter profile 42 of the cap 12 being only slightly smaller than the large diameter profile 40 of the dispensing body 14 so as to create a tight frictional engagement. As such, when the cap 12 is placed over the dispensing body 14, the large diameter profile 38 of the cap 12 initially sits over the dispensing body 14 and the small diameter profile 42 of the cap 12 engages the large diameter profile 40 of the dispensing body 14 to create a frictional connection between the cap 12 and the dispensing body 14.

A ledge 46 is formed adjacent the large diameter profile 40 of the dispensing body 14 at a position remote from the open end 22 of the dispensing body 14. The ledge 46 is formed so as to control movement of the cap 12 onto the dispensing body 14 by providing a surface which the first end 28 of the cap 12 may engage when it is fully positioned upon the dispensing body 14.

While a frictional engagement construction is disclosed above in accordance with a preferred embodiment of the present invention, other engagement structures (for example, threads) may be employed without departing from the spirit of the present invention.

As briefly discussed above, the cap 12 includes a clasp 32 to which a variety of articles may be attached. The clasp 32 includes a first arm 48 and a second arm 50. The first and second arms 48, 50 are resiliently biased so as to permit the passage of an article therebetween. The first arm 48 includes a first arcuate member 52 extending along an arc of at least 120 degrees and a first upwardly extending connecting member 54 inking the first arcuate member 52 to the cap 12. The second arm 50 includes a second arcuate member 56 extending along an arc of at least 120 degrees and a second upwardly extending connecting member 58 linking the second arcuate member 56 to the cap 12.

As a result of the opposed orientation of the first arm 48 and the second arm 50, the first and second arms 48, 50 overlap in a mating configuration with the first arm 48 lying over the second arm 50. In fact, and in accordance with a preferred embodiment of the present invention, the first arcuate member 52 and the second arcuate member 56 overlap through at least a 60 degree arc.

While preferred angular orientations are provided in describing a preferred embodiment of the present invention, the specific angular orientations are not critical to the functionality of the present dispensing container. What is critical, however, is that the first and second arms 48, 50 overlap along a significant portion of their arcs so as to create a secure attachment mechanism for readily and selectively attaching articles to the present dispensing container.

Also in accordance with a preferred embodiment of the present invention, the second arcuate member 56 has a slightly smaller radius of curvature than the first arcuate member 52. As shown, the radius of curvature for second arcuate member 56 is 0.218 inches and the radius of curvature for first arcuate member 52 is 0.281 inches. This matching relationship provides an overlap which will once again aid in securely attaching articles to the present dispensing container 10. In addition, the first arcuate member 52 extends along an arc which is larger than the arc of the second arcuate member 56. In fact, and in accordance with a preferred embodiment of the present invention, the first arcuate member 52 extends along an arc which is approximately 180 degrees and the second arcuate member 56 extends along an arc which is approximately 160 degrees. Further, the first arm 48 and the second arm 50 are positioned approximately 2 mm or less from one another.

In addition, and in order to accommodate the fact that the first arm 48 sits over the second arm 50, the first upwardly extending connecting member 54 is longer than the second upwardly extending connecting member 58. In addition, the second arcuate member 56 includes a proximal end 60 connected to the second upwardly extending connecting member 58 and a free distal end 62, and the distal end 62 is positioned closer to the first arm 48 than the proximal end 60. Further, the first arcuate member 52 includes a proximal end 64 connected to the first upwardly extending connecting member 54 and a free distal end 66, and the distal ends 62, 66 of both the first arcuate member 52 and the second arcuate member 56 are tapered.

While the use of two arms 48, 50 in accordance with the present invention optimizes attachment to various support structures, the two arms further provide for improved strength. That is, through the use of two arms 48, 50 the strength of the clasp 32 is double based upon the inherent strength of the first and second arms 48, 50. As such, if the clasp 32 were subjected to a pulling force, the second arm 50 will contact the first arm 48 to create double resistance.

While the preferred embodiments have been shown and described, it will be understood that there is no intent to limit the invention by such disclosure, but rather, is intended to cover all modifications and alternate constructions falling within the spirit and scope of the invention as defined in the appended claims.

The invention claimed is:

1. A dispensing container including a selectively removable cap to which a variety of articles may be securely and selectively attached, comprising:

a dispensing body in which material for dispensing is stored, the dispensing body including a closed end, at least one side wall and an open end through which the material is dispensed;

a cap shaped and dimensioned for selectively covering the open end of the dispensing body, the cap including a first end shaped and dimensioned for engaging the open end of the dispensing body for secure and selective attachment thereto and a closed second end including a clasp extending therefrom;

the clasp including a first arm and a second arm, the first arm includes a first arcuate member and a first upwardly extending connecting member integrally formed with the cap, and the second arm includes a second arcuate member and a second upwardly extending connecting member integrally formed with the cap; the first arm and the second arm extending from the cap in a spaced relationship and being oriented upon the cap so as to overlap in a mating configuration with the first arm lying over the second arm, the first arcuate member and the second arcuate member overlapping through a substantial portion of their respective arcs.

2. The dispensing container according to claim 1, wherein the second arcuate member has a slightly smaller radius of curvature than the first arcuate member.

3. The dispensing container according to claim 2, wherein the first arcuate member extends along an arc which is larger than the arc of the second arcuate member.

4. The dispensing container according to claim 3, wherein the first upwardly extending connecting member is longer than the second upwardly extending connecting member.

5. The dispensing container according to claim 1, wherein the first arcuate member extends along an arc which is larger than the arc of the second arcuate member.

6. The dispensing container according to claim 1, wherein the first arm and the second arm are positioned approximately 2 mm or less from one another.

7. The dispensing container according to claim 1, wherein the first upwardly extending connecting member is longer than the second upwardly extending connecting member.

8. A dispensing container including a selectively removable cap to which a variety of articles may be securely and selectively attached, comprising: a dispensing body in which material for dispensing is stored, the dispensing body including a closed end, at least one side wall and an open end through which the material is dispensed; a cap shaped and dimensioned for selectively covering the open end of the dispensing body, the cap including a first end shaped and dimensioned for engaging the open end of the dispensing body for secure and selective attachment thereto and a closed second end including a clasp extending therefrom; the clasp including a first arm and a second arm, the first arm includes a first arcuate member extending along an arc of at least 120 degrees and a first upwardly extending connecting member integrally formed with the cap, and the second arm includes a second arcuate member extending along an arc of at least 120 degrees and a second upwardly extending connecting member integrally formed with the cap; the first arm and the second arm extending from the cap in a spaced relationship and being oriented upon the cap so as to overlap in a mating configuration with the first arm lying over the second arm, the first arcuate member and the second arcuate member overlapping through at least a 60 degree arc.

9. The dispensing container according to claim 8, wherein the second arcuate member has slightly smaller radius of curvature than the first arcuate member.

10. The dispensing container according to claim 9, wherein the first arcuate member extends along an arc which is larger than the arc of the second arcuate member.

11. The dispensing container according to claim 9, wherein the first arm and the second arm are positioned approximately 2 mm or less from one another.

12. The dispensing container according to claim 9, wherein the first upwardly extending connecting member is longer than the second upwardly extending connecting member.

13. The dispensing container according to claim 8, wherein the first arcuate member extends along an arc which is larger than the arc of the second arcuate member.

14. The dispensing container according to claim 8, wherein the first upwardly extending connecting member is longer than the second upwardly extending connecting member.

15. The dispensing container according to claim 8, wherein the first arcuate member includes a proximal end connected to the first upwardly extending connecting member and a free distal end and the second arcuate member includes a proximal end connected to the second upwardly extending member and a free distal end, and wherein the distal ends of both the first arcuate member and the second arcuate member are tapered.

16. A cap to which a variety of articles may be securely and selectively attached, the cap being adapted for use in conjunction with a dispensing body in which material for dispensing is stored, the dispensing body including a closed end, at least one side wall and an open end through which the material is dispensed, wherein the cap is shaped and dimensioned for selectively covering the open end of the dispensing body, the cap comprising: a first end shaped and dimensioned for engaging the open end of the dispensing body for secure and selective attachment thereto and a closed second end including a clasp extending therefrom; the clasp including a first arm and a second arm, the first arm includes a first arcuate member and a first upwardly extending connecting member integrally formed with the cap, and the second arm includes a second arcuate member and a second upwardly extending connecting member integrally formed with the cap; the first arm and the second arm extending from the cap in a spaced relationship and being oriented upon the cap so as to overlap in a mating configuration with the first arm lying over the second arm, the first arcuate member and the second arcuate member overlapping through a substantial portion of their respective arcs.

17. The cap according to claim 16, wherein the second arcuate member has slightly smaller radius of curvature than the first arcuate member.

18. The cap according to claim 17, wherein the first arcuate member extends along an arc which is larger than the arc of the second arcuate member.

19. The cap according to claim 16, wherein the first arcuate member extends along an arc which is larger than the arc of the second arcuate member.

20. The cap according to claim 16, wherein the first arm and the second arm are positioned approximately 2 mm or less from one another.

* * * * *